US006465723B2

(12) United States Patent
Milano

(10) Patent No.: US 6,465,723 B2
(45) Date of Patent: Oct. 15, 2002

(54) AUTOMATIC STRING INSTRUMENT TUNER KIT

(76) Inventor: Lynn M. Milano, 405 Echo Ave., Sound Beach, NY (US) 11789

( * ) Notice: Subject to any disclaimer, the term of this patent is extended or adjusted under 35 U.S.C. 154(b) by 0 days.

(21) Appl. No.: 09/800,712

(22) Filed: Mar. 7, 2001

(65) Prior Publication Data

US 2002/0092408 A1 Jul. 18, 2002

Related U.S. Application Data

(60) Provisional application No. 60/187,660, filed on Mar. 7, 2000.

(51) Int. Cl.[7] ..... G10G 7/02

(52) U.S. Cl. ..... 84/454; 84/297 R; 84/274; 84/309; 84/312 R

(58) Field of Search ..... 84/454, 297 R, 84/274, 309, 312 R

(56) References Cited

U.S. PATENT DOCUMENTS 2,304,597 A * 12/1942 Prodsdorper ..... 84/297 R
2,397,289 A * 3/1946 Proll ..... 84/297 R
3,813,983 A 6/1974 Paul
4,375,180 A 3/1983 Scholz
4,791,849 A 12/1988 Kelley
4,889,029 A 12/1989 St. Denis
4,899,636 A 2/1990 Chiba et al.
4,909,126 A 3/1990 Skinn et al.
5,038,657 A 8/1991 Busley
5,095,797 A 3/1992 Zacaroli
5,390,579 A 2/1995 Burgon
5,469,770 A 11/1995 Taylor
5,689,082 A * 11/1997 Youngblood ..... 84/743
5,767,429 A * 6/1998 Milano et al. ..... 84/454
5,780,759 A 7/1998 Szalay
5,824,929 A 10/1998 Freeland et al.
5,847,302 A 12/1998 Morikawa et al.
5,854,437 A 12/1998 Merrick et al.
5,859,378 A 1/1999 Freeland et al.

* cited by examiner

*Primary Examiner*—Shih-Yung Hsieh
(74) *Attorney, Agent, or Firm*—Dilworth & Barrese, LLP

(57) ABSTRACT

A kit for automatically tuning a string musical instrument such as a guitar, violin, cello, viola, etc., includes a controller, a tail piece for attachment to the string musical instrument, a string tension adjustment mechanism, a pickup for detecting the vibration frequency of the string and producing a pickup signal corresponding to the vibration frequency, and a motorized wrench controlled by a control signal received from the controller, the motorized wrench being engageable with the string tension adjustment mechanism. The pickup signal is communicated to the controller, which sends a signal to the motorized wrench to adjust the tension of the string.

9 Claims, 2 Drawing Sheets

AUTOMATIC STRING INSTRUMENT TUNER KIT

This application claims the benefit of provisional application Serial No. 60/187,660 filed Mar. 7, 2000.

BACKGROUND

1. Technical Field

The present invention relates to a tuning apparatus kit for automatically tuning stringed musical instruments.

2. Background of the Related Art

An automatic string instrument tuner is described in U.S. Pat. No. 5,767,429, which is herein incorporated by reference in its entirety. The tuner described therein includes, inter alia, means for detecting a musical tone produced by a vibrated string, means for comparing the tone to a reference value associated with a desired frequency, and means for individually adjusting tension on the strings to bring the produced musical tone into conformity with the desired reference tone.

What is desired is a system for retrofitting standard stringed instruments to accomplish tuning of the instrument easily and quickly.

SUMMARY

An automatic string instrument tuner kit is provided herein which includes a controller, connecting jacks, a tail piece with visual indicators and string tension adjustment mechanism, a pickup for detecting the frequency of the strings, and a motorized wrench.

BRIEF DESCRIPTION OF THE DRAWINGS

Various embodiments are described below with reference to the drawings wherein.

DETAILED DESCRIPTION OF THE PREFERRED EMBODIMENT(S)

Figure 1:
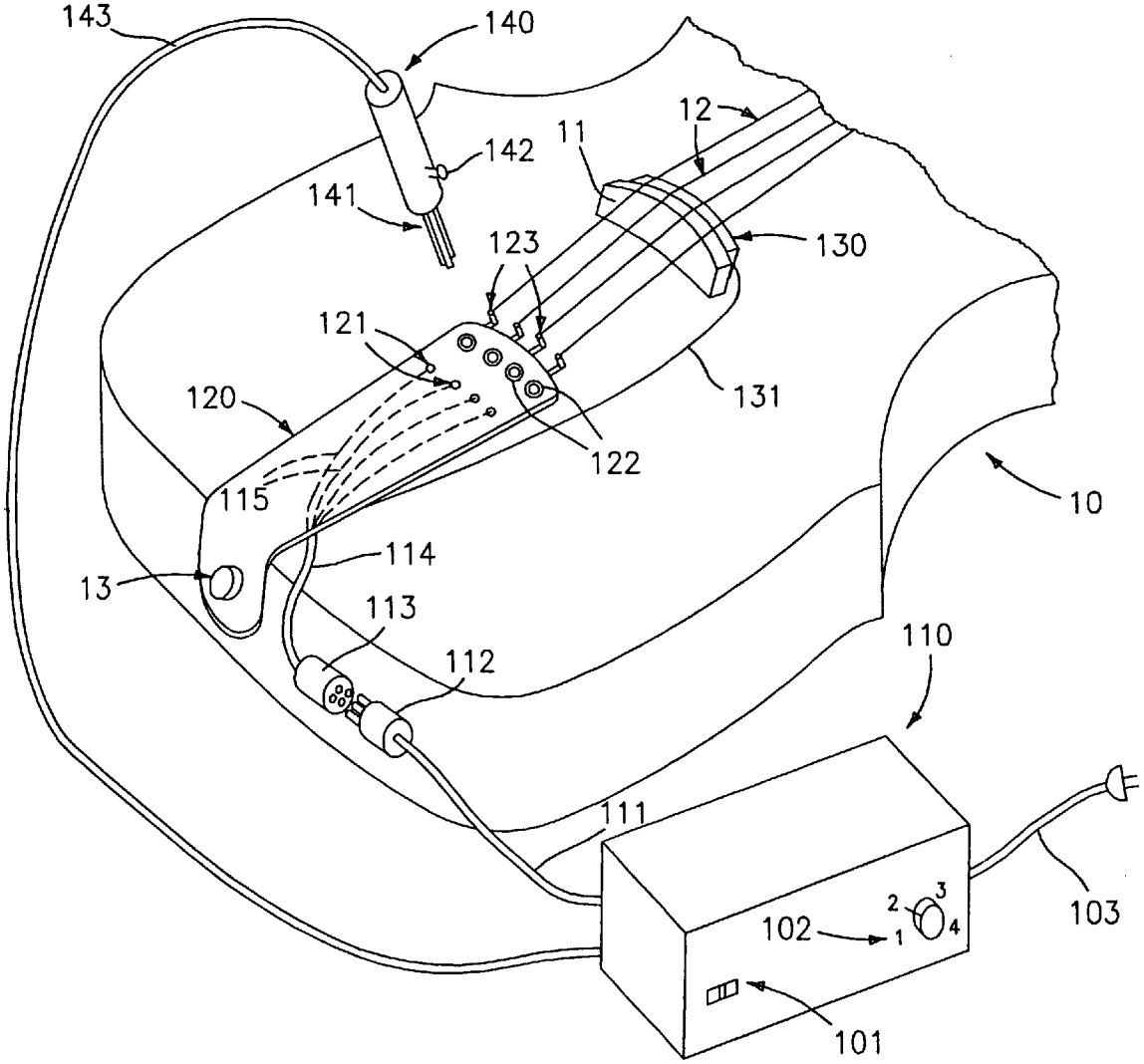
FIG. 1 is a perspective view of the automatic string tuner kit of the present invention in conjunction-with a string instrument.
Figure 2:
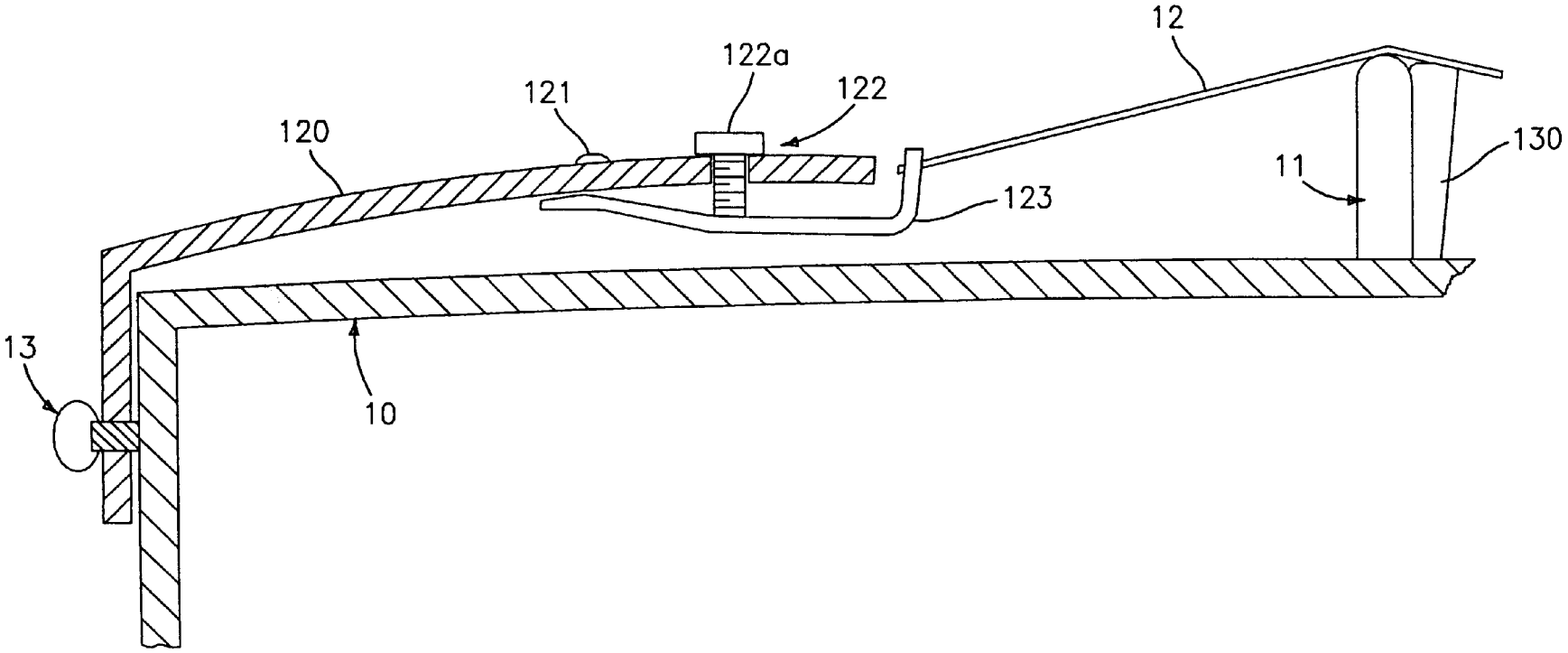
FIG. 2 is a partly sectional side elevational view of the tail piece and tension adjustment mechanism.

Referring to FIGS. 1 and 2, the automatic string tuner kit of the present invention includes a controller 110, connecting jacks 112 and 113, tail piece 120 with visual indicators and string tension adjustment mechanism, a pickup 130 for detecting the tone or frequency of the strings, and a motorized wrench 140.

More particularly, controller 110 includes an enclosed microprocessor and means for generating a user selected desired reference frequency for comparison. Controller 110 includes an on/off switch 101 and a selector switch 102 for selecting the desired reference frequency. Controller 110 may be battery powered and/or connected to a standard electrical outlet by a power cord 103. Electric line 111 extends from the controller 110 and terminates in a jack 112, which is connectable to corresponding receiving jack 113. Electric line 143 extends from controller 110 and terminates in a hand-held motorized wrench 140.

Pickup 130 can include a transducer and is preferably positioned in abutment to bridge 11 of the string musical instrument (e.g., guitar, violin, cello, viola, etc.). Pickup 130 individually detects the vibrational frequency of the vibrating strings 12 and converts the tone to an electrical signal which is transmitted via electrical line 131 through cable 114 to jack 113.

Tail piece 120 is adapted to replace the standard tailpiece of the musical instrument and typically connects to the body 10 of the musical instrument by means of button 13. Tail piece 120 includes a plurality of visual indicators, preferably light emitting diodes ("LED") 121, each of which is connected by a respective electrical line 115 through cable 114 to jack 113. The tail piece 120 preferably includes one LED for each string 12.

Tail piece 120 further includes a tension adjustment mechanism which includes, for each string, a screw 122 and tensioning lever 123. Screw 122 is disposed through an opening in the tail piece and, when rotated, is movable toward or away from tensioning lever 123. An end of each string 12 is fixedly attached to a respective tensioning lever 123. When the screw 122 is rotated so that it advances toward tensioning lever 123, the end of screw 122 pushes the tensioning lever 123 downward (as shown), which thereby imparts more tension to the string 12. When the screw 122 is rotated in the opposite direction it moves upward and the tensioning lever 123 is allowed to relax, thereby reducing tension in the corresponding string. Screw 122 preferably includes a hex socket head 122*a* for engagement with a hex wrench tool.

Motorized wrench 140 includes an on/off switch 142 and a rotatable hex tool 141, which is adapted to engage hex socket head 122*a* of the screw 122. The motor is reversible so that the hex tool 141 can be rotated alternatively in the clockwise or counter-clockwise directions. Motorized wrench 140 is connected to the controller 110 by electrical line 143.

In operation, the user substitutes the tail piece 120 of the present kit for the original tail piece of the musical instrument, and positions the pickup 130 in abutment with the bridge 11. Jack 112 is inserted into receiving jack 113 to effect electrical connection between the pickup 130 and the controller 110, and between the LEDs 121 and the controller 110. The selector switch 102 of the controller 110 is positioned to select the string to be tuned. The selected string 12 is activated by plucking and the pickup 130 detects the frequency of the tone and sends a signal to controller 110 wherein the frequency is compared to the reference standard. If the string is out of tune the corresponding LED will flash red. The user inserts the hex tool 141 into the hex socket head 122*a* of the screw and presses switch 142 to activate the wrench 140. The controller 110 sends a signal to the motorized wrench 140 to rotate one way or the other to lower or raise screw 122. This, in turn, applies more or less tension to the string 12, which increases or decreases the frequency of the produced tone until the produced tone is in accordance with the desired standard. When the string 12 is in tune the corresponding LED flashes green and the user repeats the process for the next string.

What is claimed is:

1. An automatic tuner kit for a string musical instrument including at least one string which comprises:

a) a controller;

b) a tail piece for attachment to the string musical instrument;

c) a string tension adjustment mechanism for adjusting tension of the at least one string;

d) a pickup for detecting the vibration frequency of the string and producing a pickup signal corresponding to said vibration frequency;

e) means for communicating the pickup signal to the controller;

f) a motorized wrench controlled by a control signal received from the controller, the motorized wrench being engageable with the string tension adjustment mechanism;

g) means for communicating the control signal to the motorized wrench; and h) a visual indicator for visually indicating the state of tune of the at least one string.

2. The kit of claim 1, wherein a visual indicator is provided for each string of the instrument.

3. The kit of claim 2 wherein each visual indicator includes a light emitting diode.

4. The kit of claim 3 wherein each visual indicator is electrically connected to the controller.

5. The kit of claim 1 wherein the string musical instrument includes a plurality of strings and the controller includes means for selecting a predetermined frequency for each string.

6. The kit of claim 1 wherein the string tension adjustment mechanism includes a screw movably disposed through an opening in the tail piece between a first position and a second position, and a tensioning lever attached to the string and movable in response to the screw such that when the screw is in the second position more tension is applied to the string than when the screw is in the first position.

7. The kit of claim 6 wherein the motorized wrench includes a tool selectively rotatable in the clockwise or counterclockwise direction, the tool being engageable with the screw of the sting tension adjustment mechanism.

8. The kit of claim 1 wherein the means for communicating the pickup signal to the controller includes a pair of removably engageable connecting jacks.

9. The kit of claim 1 wherein the string musical instrument is selected from the group consisting of guitar, violin, cello and viola.

* * * * *